US005558153A

United States Patent [19]

Holcombe et al.

[11] Patent Number: 5,558,153

[45] Date of Patent: Sep. 24, 1996

[54] METHOD & APPARATUS FOR ACTUATING A DOWNHOLE TOOL

[75] Inventors: Michael W. Holcombe, Katy; David E. Rothers, Houston; Steve C. Owens, Katy; William D. Henderson, League City; James C. Doane, Friendswood, all of Tex.

[73] Assignee: Baker Hughes Incorporated, Houston, Tex.

[21] Appl. No.: 326,824

[22] Filed: Oct. 20, 1994

[51] Int. Cl.[6] ..... E21B 23/04

[52] U.S. Cl. ..... 166/373; 166/66.7; 166/376

[58] Field of Search ..... 166/373, 376, 166/387, 65.1, 66.6, 66.7

[56] References Cited

U.S. PATENT DOCUMENTS

| | | |
|---|---|---|
| Re. 30,055 | 7/1979 | Claycomb . |
| Re. 32,463 | 7/1987 | Westlake et al. . |
| 3,659,259 | 4/1972 | Chaney, Jr. et al. . |
| 3,711,825 | 1/1973 | Claycomb . |
| 3,713,089 | 1/1973 | Clacomb . |
| 3,792,428 | 2/1974 | Harrell et al. . |
| 3,800,277 | 3/1974 | Patton et al. . |
| 3,863,203 | 1/1975 | Patton et al. . |
| 3,867,714 | 2/1975 | Patton . |
| 3,982,224 | 9/1976 | Patton . |
| 4,027,282 | 5/1977 | Jeter . |
| 4,216,536 | 8/1980 | More . |
| 4,314,365 | 2/1982 | Peterson et al. . |
| 4,351,037 | 9/1982 | Scherbatskoy . |
| 4,386,422 | 5/1983 | Mumby et al. . |
| 4,405,021 | 9/1983 | Mumby . |
| 4,499,563 | 2/1985 | Jurgens . |

(List continued on next page.)

FOREIGN PATENT DOCUMENTS

| | | |
|---|---|---|
| 2264135A | 8/1993 | United Kingdom . |
| 2267922A | 12/1993 | United Kingdom . |

OTHER PUBLICATIONS

Du Pont PYRALUX Flexible Composites, Section II, Oct., 1986.

Du Pont PYRALUX Flexible Composites, Section X, Oct., 1986.

(List continued on next page.)

*Primary Examiner*—William P. Neuder

*Attorney, Agent, or Firm*—Rosenblatt & Redano P.C.

[57] ABSTRACT

A downhole tool, comprising one or more separate packers and sliding sleeves in the preferred embodiment, is actuable from a nonelectrical signal transmitted from the surface to the tool. The signal is received at the tool by a control system located within the tool. The control system operates in conjunction with a power supply in the tool to accomplish tool actuation. In the preferred embodiment, the valve member is temporarily retained in a sealing position, isolating pressure in one chamber from a different pressure in an adjacent chamber. The valve member or piston is temporarily retained by a high-strength fiber, such as Kevlar®, in the preferred embodiment. The control system actuates the power source to heat a resistance heating wire, which causes failure in the fiber. Other mechanisms to trigger pressure-equalization can be used. The fiber can be cut by a cutter actuated electrically. The piston can be retained by solder which is melted electrically. The piston can be designed to be substantially in pressure balance so that the fiber can effectively hold the piston in place until it is rendered inoperative by heating up a resistance wire from the power supply as triggered by the control circuit. Once the fiber fails, the piston is released and the pressure is equalized. The pressure-equalization can be used to shift a setting sleeve to set a packer or to open or close a sliding sleeve valve. Different valves can be actuated in series, using different control signals, or in parallel, using one control signal. In the alternative, the same valve can be actuated to open and then to close, depending on the procedures desired. The resistance wire is threaded into the fiber cable to ensure effective transmission of the heat for proper release of the piston when desired.

38 Claims, 11 Drawing Sheets

U.S. PATENT DOCUMENTS

| | | | |
|---|---|---|---|
| 4,520,468 | 5/1985 | Scherbatskoy . | |
| 4,553,226 | 11/1985 | Scherbatskoy . | |
| 4,619,320 | 10/1986 | Adnyana et al. | 166/66.7 |
| 4,628,495 | 12/1986 | Peppers et al. . | |
| 4,641,289 | 2/1987 | Jurgens . | |
| 4,703,461 | 10/1987 | Kotlyar . | |
| 4,763,520 | 8/1988 | Titchener et al. . | |
| 4,839,870 | 6/1989 | Scherbatskoy . | |
| 5,226,491 | 7/1993 | Pringle et al. | 166/66.7 |
| 5,226,494 | 7/1993 | Rubbo et al. . | |
| 5,343,963 | 9/1994 | Bouldin et al. . | |
| 5,392,860 | 2/1995 | Ross | 166/376 |
| 5,456,316 | 10/1995 | Owens et al. . | |

OTHER PUBLICATIONS

Cylindrical Laser Lithium Primary Batteries (Bobbin structure), Lithium Primary Batteries, pp. 11–12.

Proceedings, Measurement While Drilling Symposium, Louisiana St. Univ. Baton Rouge, LA, 277–297, Feb. 1990.

Thomas S. Matthews, *Bidirectional Telemetry for Downhole Well Logging*, Petroleum Engineer, 56–62, Sep.

Allen B. Holmes, *New Generation of MWD Systems Show Promise*, Petroleum Engineer, 36–44, May 1987.

John E. Fontenot, *Measurement While Drilling—A New Tool*, Journal of Petroleum Technology, 128–130, 1986.

Robert Desbrandes, et al., *MWD Transmission Data Rades Can be Optimized*, Petroleum Engineer, 46–52, Jun. 1987.

Ralph F. Spinner, et al., *MUD Pulse Telemetry System Used in Directional Drilling*, prepared for the Department of Energy, 1–22.

Allen B. Holmes, *Fluidic Mud Pulser for Measurements While Drilling (MWD) Systems*, 45–55.

John E. Fontenot, *The Place of Technology for Measurement While Drilling in the Ocean Margin Drilling Program*, 11–16.

John Pedigo, et al., *An Acoustically Controlled Down–Hole Safety Valve, (SCSSSV)*, Society of Petroleum Engineers of AIME, SPE 6026, 1976.

B. J. Patton, et al., *Development and Successful Testing of a Continuous–Wave, Logging–While–Drilling Telemetry System, Journal of Petroleum Technology*, 1215–1221, Oct. 1977.

William D. Squire, *A New Approach to Drill–String Acoustic Telemetry*, Society of Petroleum Engineers of AIME, SPE 8340, 1979.

Robert Newton, et al., *A Case Study Comparison of Wells Drilled With and Without MWD Directional Surveys on the Claymore Platform in the North Sea*, Journal of Petroleum Technology, 1867–1876, Nov. 1980.

Wilton Gravley, *Review of Downhole Measurements–While Drilling Systems*, Society of Petroleum Engineers, SPE 10036, 1982.

Marvin Gearhart, et al., *Mud Pulse MWD Systems Report*, Journal of Petroleum Technology, 2301–2306, Dec. 1981.

David G. Franz, *Downhole Recording System for MWD*, Society of Petroleum Engineers of AIME, SPE 10054, 1981.

D. R. Tanguy, et al., *Applications of Measurements While Drilling*, Society of Petroleum Engineers, of AIME, SPE 10324, 1981.

Andrew Roberts, et al., *MWD Field Use and Results in the Gulf of Mexico*, Society of Petroleum Engineers of AIME, SPE 11226, 1982.

Anthony W. Kamp, *Downhole Telemetry From the User's Point of View*, Journal of Petroleum Technology, 1792, Oct. 1983.

Anthony W. Kamp, *Downhole Telemetry From the User's Point of View*, Society of Petroleum Engineers of AIME, SPE 11227, 1982.

J. B. Cheatham Jr., *Drilling Technology: Present Trends and Future Projects*, Society of Petroleum Engineers of AIME, SPE 12358, 1983.

L. R. Elliott, et al., *Recording Downhole Formation Date–While Drilling*, Society of Petroleum Engineers of AIME, SPE 12360, 1983.

S. J. Chen, et al., *Numerical Simulation of MWD Pressure Pulse Transmission*, Society of Petroleum Engineers, SPE 14324, 1985.

J. L. Marsh, et al., *Measurement–While–Drilling Mud Pulse Detection Process: An Investigation of Matched Filter Responses to Simulated and Real Mud Pressure Pulses*, Society of Petroleum Engineers, SPE 17787, 1988.

William J. McDonald, et al., *MWD Will Broaden Offshore Horizons*, Offshore, 87–91, Dec. 1977.

Robert O. Frederick, *MWD A Tough Nut With a Bright Future*, Drilling, Jul. 1980.

L. J. Field, et al., *Automatic Bit Locator Uses Mud Pulse Telemetry for Wellbore Steering*, Technology, 155–167, Apr. 1981.

*A Guide to Remote Control Systems*, Offshore Service, Mar.

*Combining MWD Systems into a Single Package*, The Oilman, 40,43, Nov. 1986.

*NL Uncovers Neutron MWD Tool*, The Oilman, 36, Nov. 1986.

*Elapsed Time Logging*, The Oilman, 8, Nov. 1986.

*MWD Economics Still a Problem*, Offshore, 66–67, Oct. 1984.

Alun Whittaker, et al., *Realtime Logging Combining MWD with Surface Measurements for Complete Well Evaluation*, Drilling, 14–17, Jan.–Feb. 1987.

*MWD Update: New Systems Operating*, Oil & Gas Journal, 126–148, Mar. 1980.

Thomas R. Bates, Jr., et al., *Multisensor Measurements–While–Drilling Tool Improves Drilling Economics*, OJI Report, 119–137, Mar. 1984.

Will Honeyborne, *Formation MWD Benefits Evaluation and Efficiency*, Technology, 83–92, Feb. 1985.

Will Honeyborne, *Future Measurement–While–Drilling Technology Will Focus on Two Levels*, OGJ Report, 71–75, Mar. 1985.

M. Vikram Rao, et al., *Many Factors Determine Need for Real–time or Recorded Data*, Technology, 65–69, Jan. 1988.

John E. Fontenot, et al., *Measurement While–Drilling Essential to Drilling*, Technology, 52–58, Mar. 1988.

T. R. Bates, et al., *Downhole Measurements While Drilling*, Eleventh World Petroleum Congress, vol. 3, 25–33.

R. L. Monti, et al., *Optimized Drilling—Closing the Loop*, Twelfth World Petroleum Congress, vol. 3, 131–142, 1979.

William J. McDonald, *MWD Looks Best for Directional Work and Drilling Efficiency*, Technology.

Bernard V. Traynor, Jr., *Electrodril Demonstration Program Shows Promise, MWD*: State of the Art–3, 13–20.

R. F. Spinner, et al., *MWD Program Nearing Commerciality, MWD*: State of the Art–4, 21–28.

*Gearhart–Qwen uses Negative Pressure Pulse in MWD, MWD*: State of the Art–7, 37–39.

*Majors do Basic Research on MWD, MWD*: State of the Art–9, 45–55.

William J. McDonald, et al., *Logging While Drilling: A Survey of Methods and Priorities,* SPWLA Seventeenth Annual Logging Symposium, 1–15, Jun. 1976.
Wanye Sullivan, *Teleorienter Can Speed Directional Drilling*, The Drilling Contractor, 32–35, Jan.–Feb. 1974.
F. W. Legros, Jr., *Multisensor MWD System Successfully Used*, Drilling Contractor, 32–34, Jun. 1985.
Arnold G. Edwards, et al., *New Equipment Permits Perforating, Testing, Treating and Re–Testing With One Trip in the Hole,* European Offshore Petroleum Conference & Exhibition, 321–325, Oct. 1978.
Ann Cozens, *Coming Soon: A New Era in Drilling*, Offshore, 78–82, Dec. 1977.
William J. McDonald, *Four Basic Systems Will be Offered*, Offshore, 92–103, Dec. 1977.
Chuck McCabe, *MWD Innovations Could Sharply Reduce Drilling Costs*, Ocean Industry, 38–40, Jun. 1984.
John E. Fontenot, *Measurement While Drilling—A New Tool*, Journal of Petroleum Technology, 128–130, Feb. 1986.
J. L. Thorogood, *Discussion of MWD North Sea Field Use, Aug. 1978–Feb. 1979 (with 1982 Update)*, Journal of Petroleum Technology, 905–907, May 1983.
Donald S. Grosso, et al., *Report on MWD Experimental Downhole Sensors*, Journal of Petroleum Technology, 899–904, May 1983.
Marvin Gearhart, et al., *Mud Pulse MWD Systems Report*, Journal of Petroleum Technology, Dec. 1981.
E. B. Denison, *High Data–Rate Drilling Telemetry System*, Journal of Petroleum Technology, 155–163, Feb. 1979.
*Magnetic Particle Inspection*, Non–Destructive Testing, 18–31.

METHOD & APPARATUS FOR ACTUATING A DOWNHOLE TOOL

FIELD OF THE INVENTION

The field of this invention relates to actuation of a downhole tool, preferably the types of tools which have a self-contained electrical power source and are actuable from the surface by nonelectrical signals.

BACKGROUND OF THE INVENTION

In the past, downhole tools have been positioned in a desired location by a variety of different ways. A tubing string can be assembled at the surface with the tool at the bottom for accurate placement of the tool at the desired location. Alternatively, coiled tubing can be used as well as mechanical cables or an electric line which combines the feature of mechanical support for the tool as well as the possibility of conduction of power control signals and data to and from the surface to the electrical components in the tool downhole. One of the disadvantages of using electric line is that special equipment needs to be provided for use of the electric line. In many cases, particularly offshore, space is at a premium and it is difficult to find a suitable location for the surface equipment needed to run the electric line. Additionally, the use of an electric line, or wireline, requires not only rental of the wireline equipment but also a wireline crew to operate the equipment. It is far more desirable from an operator's standpoint to use standard rig equipment to position a downhole tool for proper downhole actuation.

Some types of downhole tools have valves which require movement to selectively equalize pressures in two isolated zones which could vary substantially prior to valve actuation. Typically in these layouts, substantial amounts of energy are required to trigger valve movement. In these prior designs, the valve member would be actuable by a solenoid or a drive power screw or some other means that was connected to a downhole power source. However, due to the high power requirements and the limited space available for the downhole tools, problems arose in being able to locate within the tool a power supply of sufficient energy to actuate the valve element in view of the great disparity in pressures from two different zones across a valve member.

As previously stated, the power could come from the surface to the final control element, such as a solenoid valve located in the tool. However, such an arrangement would require the use of a wireline and the necessary incremental cost for having a wireline crew and equipment at the rig site. When using a purely mechanical support mechanism which permits rapid placement of the tool at the desired depth, such as a cable support operated from the rig drawworks, there no longer is the ability to provide the power supply from the surface to the tool located downhole. The apparatus of the present invention illustrates a tool that can provide selective communication between two pressure zones of differing pressures, based on a low-power power supply located within the tool which is actuable from the surface by a variety of nonelectrical means. Signals may be sent from the surface mechanically through motions or impacts imparted to either a support cable or a tubing string. One such method of transmission of such signals is disclosed in U.S. Pat. Nos. 5,226,494 and 5,343,963, as well as pending applications commonly assigned Ser. Nos. 08/071,422, filed Jun. 3, 1993 (Owens), and 07/751,861, filed Aug. 28, 1991 (Rubbo), which involves production of acoustical signals which pass through a conduit wall and are detectible by a strain gauge assembly on a downhole tool, to generate a signal for actuating the downhole tool using a downhole energy source. Signals can also be acoustically transmitted through the wellbore fluids where they are sensed at the tool downhole. Regardless of how the signal is transmitted, it is received at the tool where the control circuitry closes a circuit. In the preferred embodiment, the valve member is temporarily retained by a fastening mechanism, which in the preferred embodiment is a Kevlar® cable, wrapped with a heating element. When the control circuit is actuated to provide power to a heating element, the Kevlar® cable breaks and the differential pressure across the valve member actuates the valve member, thus opening fluid communication between what had previously been two zones isolated from each other at different pressures. Thereafter, once the valve member has shifted and various seals have moved, allowing a flow opening to be created between a zone of high pressure and a zone of lower pressure, flow through the tool is initiated. This flow can be used to move a piston or a setting sleeve, making the apparatus particularly useful in setting packers, as will be described below.

SUMMARY OF THE INVENTION

A downhole tool, comprising one or more separate packers and sliding sleeves in the preferred embodiment, is actuable from a nonelectrical signal transmitted from the surface to the tool. The signal is received at the tool by a control system located within the tool. The control system operates in conjunction with a power supply in the tool to accomplish tool actuation. In the preferred embodiment, the valve member is temporarily retained in a sealing position, isolating pressure in one chamber from a different pressure in an adjacent chamber. The valve member or piston is temporarily retained by a high-strength fiber, such as Kevlar®, in the preferred embodiment. The control system actuates the power source to heat a resistance heating wire, which causes failure in the fiber. Other mechanisms to trigger pressure-equalization can be used. The fiber can be cut by a cutter. The piston can be retained by a metal or a plastic which is deformed by some means. The piston can be designed to be substantially in pressure balance so that the fiber can effectively hold the piston in place until it is rendered inoperative by degrading its integrity when triggered by the control circuit. Once the fiber fails, the piston is released and the pressure is equalized. The pressure-equalization can be used to shift a setting sleeve to set a packer or to open or close a sliding sleeve valve. Different valves can be actuated in series, using different control signals, or in parallel, using one control signal. In the alternative, the same valve can be actuated to open and then to close, depending on the procedures desired. The resistance wire is threaded into the fiber cable to ensure effective transmission of the heat for proper release of the piston when desired.

DETAILED DESCRIPTION OF THE PREFERRED EMBODIMENT

Figure 1:
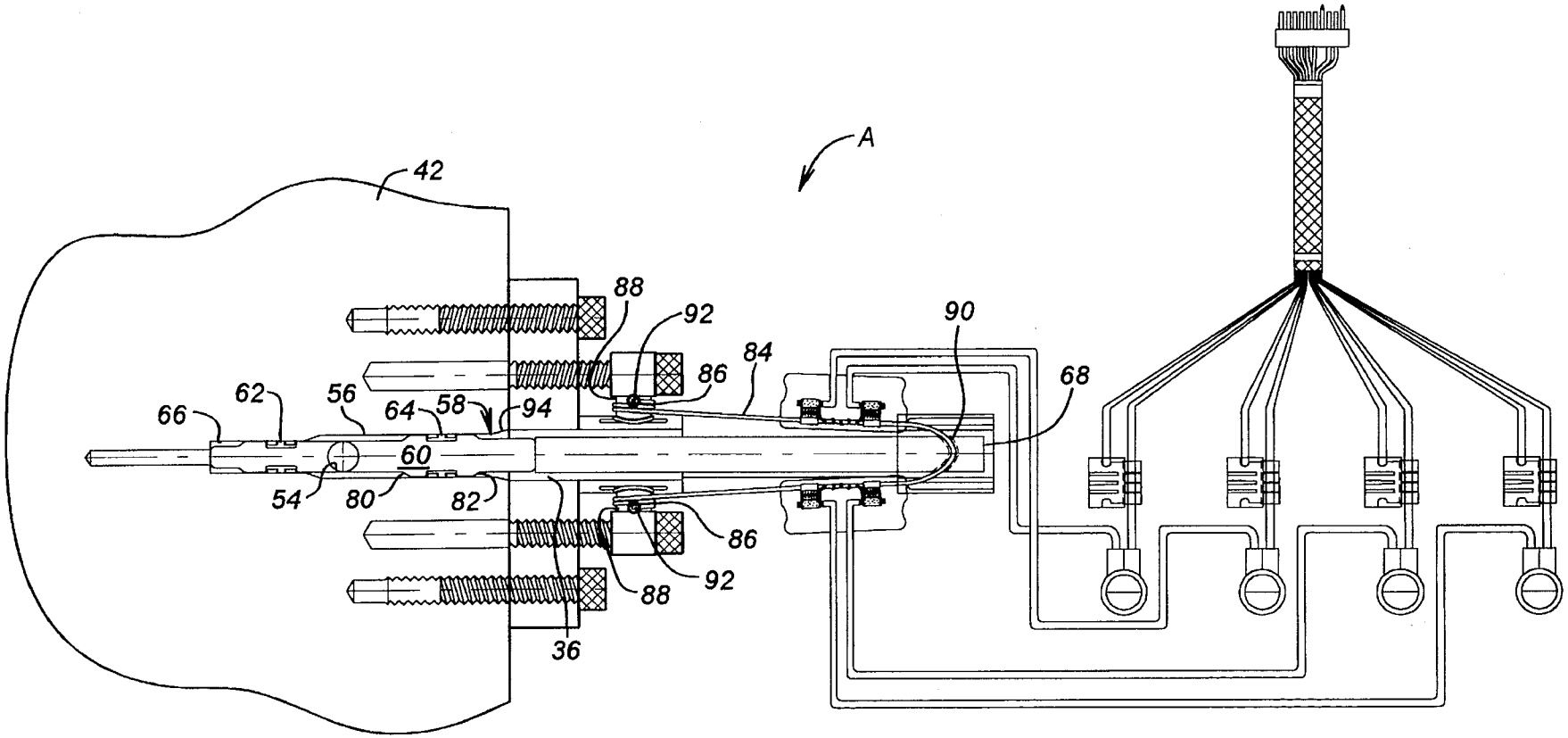
FIG. 1 is a part view of the preferred embodiment for a packer shown in the run-in position.
Figure 2A:
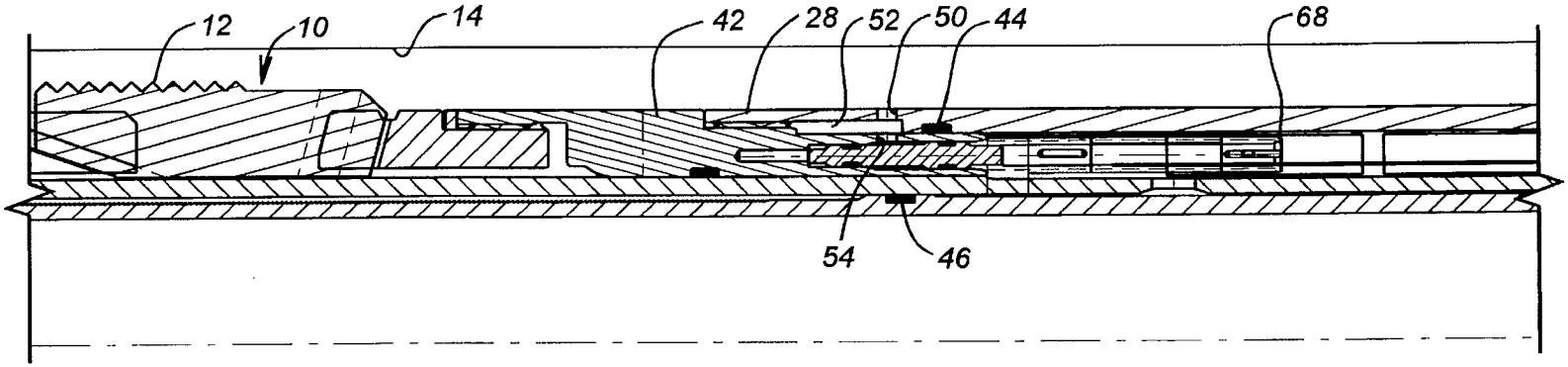
FIGS. 2A and 2B illustrate the overall assembly in a packer, using the preferred embodiment illustrated in FIG. 1.
Figure 2B:
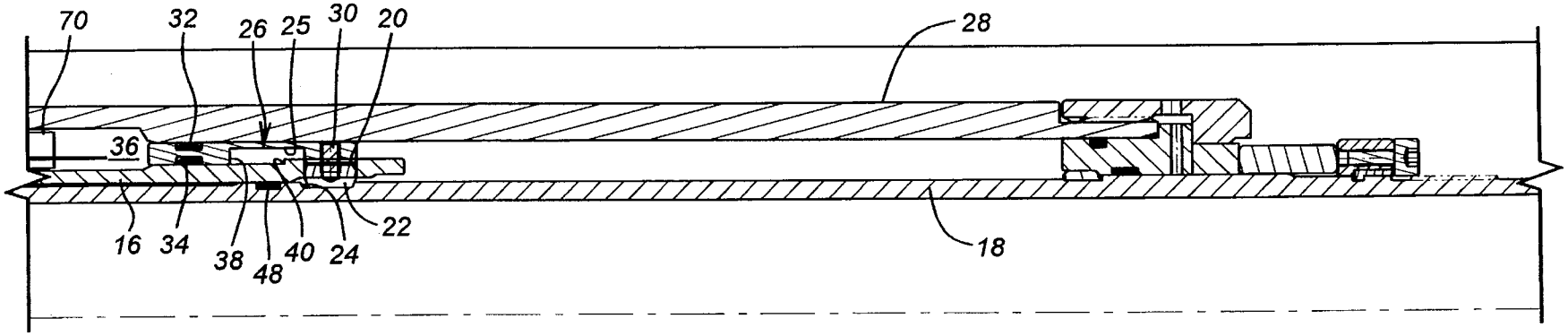

Referring now to FIGS. 1, 2A, and 2B, a typical packer assembly is illustrated in part. The components not mentioned are those that are familiar to a person of skill in the art. For a frame of reference, FIGS. 2A and 2B illustrate a series of slips 10, which have teeth 12 and are selectively movable outwardly into contact with a casing or formation 14. Not shown, but also included in a typical packer assembly, are one or more sealing elements, which are also actuated into contact with the casing 14 contemporaneously with the outward urging of the slips 10 to fixate the packer. In order to accomplish the setting movements necessary to set the sealing elements (not shown) and the slips 10, a setting sleeve 16 is mounted over a mandrel 18. In the run-in position shown, the setting sleeve 16 has an opening 20 through which extends a key or "locking dog"22. The key 22 extends into groove 24 in the mandrel 18. Key 22 is fixed in its position in groove 24 by virtue of piston 26, which extends between outer sleeve 28 and key 22, preventing key 22 from coming out of groove 24. Piston 26 is initially connected to key 22 by shear pin 30. Seals 32 and 34 seal, respectively, between piston 26 and outer sleeve 28 and sleeve 16. Accordingly, a cavity 36 is defined above piston 26, whereupon, as will later be explained, when a pressure build-up occurs in cavity 36, piston 26 is urged to move downwardly, shearing pin 30. Piston 26 is then able to translate with respect to setting sleeve 16 until shoulder 38 bottoms on shoulder 40 of setting sleeve 16. At that point, pressure in cavity 36 moves piston 26 in tandem with setting sleeve 16, which in turn results in setting of the slip 10 and the packing element or elements (not shown). Those skilled in the art will appreciate that more than one set of slips can be employed in packers that are known in the art. It can also be seen that when piston 26 translates with respect to setting sleeve 16, the key or locking dog 22 becomes liberated and can move radially outwardly out of groove 24, which in turn permits downward motion of setting sleeve 16. This occurs because recess 25 moves opposite key 22 at the time shoulders 38 and 40 contact.

The preferred embodiment of the apparatus A of the present invention works in conjunction with the assembly of the piston 26 and setting sleeve 16, as previously described. The purpose of the apparatus A is to permit the actuation of the setting sleeve 16 while taking advantage of differential pressure available downhole and accomplishing this task using a nonelectrical signal provided from the surface. To appreciate the operation of the apparatus A of the present invention, the overall layout shown in FIGS. 1, 2A, 2B, and 7 must be reviewed.

Figure 7:
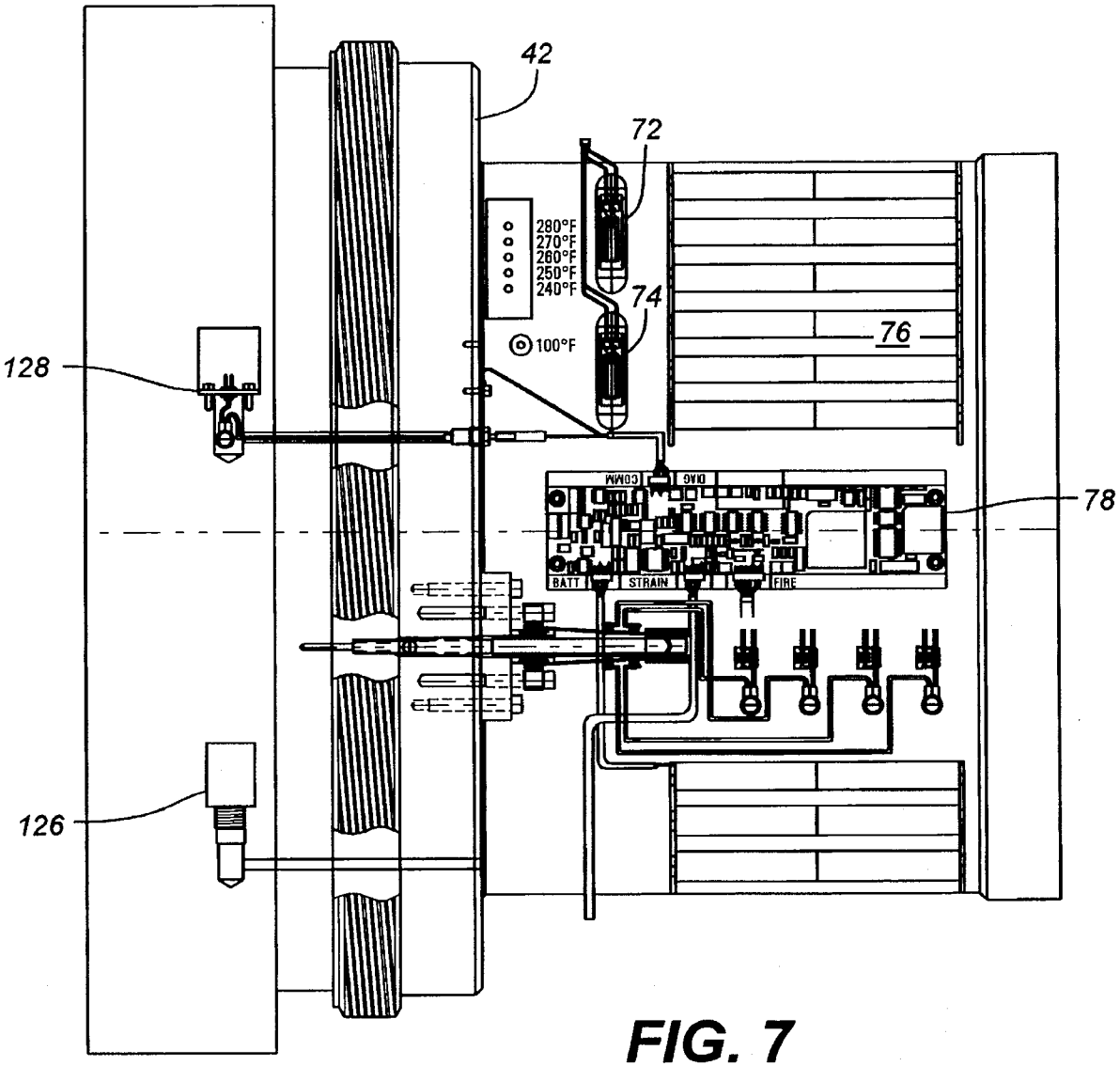
FIG. 7 is an overall assembly of the preferred embodiment shown in FIG. 1, illustrating the physical layout of the components, both mechanical and electrical.

Referring now to FIGS. 1 and 7, when using the apparatus A in a packer assembly, the packer assembly has generally a housing 42 which is connected to the outer sleeve 28 (see FIGS. 1 and 2A). The housing 42 is mounted with a seal 44 mounted between housing 42 and outer sleeve 28. Seals 46 and 48 seal between mandrel 18 and setting sleeve 16. A lateral bore 50 extends to outer sleeve 28 and into chamber 52 and further out of chamber 52 through bore 54 and into chamber 56, as shown in FIGS. 1 and 2A.

The details of chamber 56 are shown in FIG. 1. Defining chamber 56 is a passage 58 incorporated into housing 42. Installed within passage 58 is a piston 60. Seal or seals 62 and 64, respectively, serve to isolate chamber 56 within passage 58 such that wellbore pressure enters through bore 54 and fills chamber 56 during the run-in condition illustrated in FIG. 1. As shown in FIG. 1, passage 58 can optionally extend beyond seal 62, thus defining a subchamber 66 which is at atmospheric pressure when the tool is assembled at the surface. In view of the presence of seal 62, the pressure remains essentially atmospheric in subchamber 66 until there is movement of piston 60. The pressure in subchamber 66 acts to push the piston 60 against the restraint provided by cable 84. The use of subchamber 66 defined by installing seal 62 is optional. As illustrated in FIG. 1, piston 60 is exposed to the initial pressure in chamber 36 (see FIG. 2B). FIG. 1, for simplicity, leaves out the adjacent components; however, FIG. 2A clearly illustrates that the lower end 68 is disposed within chamber 36. Also illustrated schematically in FIG. 2B is the disposition of the electronic components, which is schematically represented by a box 70 shown in FIG. 2B. The actual physical layout of the electronic components within chamber 36 is more clearly illustrated in FIG. 7. The major components of the electrical system 70, as shown in FIG. 7, are the strain gauge or gauges 72 and 74, the battery pack 76, and the printed circuit board 78. The details of the operation of the electronic components will be described below.

It is important to note that during the run-in position, chamber 36, which contains the electrical components 70, is sealingly isolated from wellbore fluids found either within the mandrel 18 or in the annulus outside the outer sleeve 28, through the seals that have been previously described. As shown in FIG. 1, there is a net unbalanced force acting on piston 60. This unbalanced force is created because the pressure in chamber 56 acting on shoulder 80 creates a greater force downwardly on piston 60 than the opposing force which consists of atmospheric pressure in chamber 36 acting on shoulder 82 and lower end 68. Those skilled in the art will appreciate that the configuration of piston 60 can be adjusted to create any desired unbalanced force on the piston 60, knowing the pressures in chambers 56 and 36. The unbalanced force previously referred to is resisted by a multi-strand Kevlar® cable 84, which has windings 86 around a bolt or turnbuckle 88. The cable 84 is preferably a Kevlar® 29 Aramid braided yarn, such as can be purchased from Western Filaments, Inc., product number 500 KOR 12. This is a continuous multi-filament fiber cable braided into a round form in a tubular braid configuration with a 2-under and 2-over braid pattern on a 12-carrier braid. The cord diameter is preferably ±0.057", ±0.005", with a break strength of 500 lbs., ±10 lbs. This material is also preferred because its zero strength temperature is 850° F. and it retains 90% strength at 482° F. This fiber begins to decompose at 800° F. when tested in accordance with ASTM D276-80. Cable 84 extends through an opening 90, preferably adjacent the lower end 68 of piston 60. With that arrangement shown and the ends of the Kevlar® cable 84 tied in a knot after passing through openings 92, the piston 60 is secured against movement, thus retaining the integrity of chamber 56 with respect to passage 58 in view of seals 62 and 64.

When the cable 84 is caused to fail, as will be described below, the net unbalanced force on piston 60 causes it to move downwardly within chamber 36 toward piston 26 (see FIG. 2B). After sufficient movement of piston 60, seal 64 clears taper 94 on housing 42, thereby allowing the fluids in the wellbore and in chamber 56 to pass around seal 64 and into chamber 36. The pressure in chamber 36 up until movement of piston 60 has been atmospheric. Upon defeat of seal 64, the pressure rises in chamber 36 to a point where shear pin 30 (see FIG. 2B) is broken, allowing piston 26 to move downwardly until shoulder 38 bottoms on shoulder 40. Thereafter, the pressure within chamber 36 continues to urge piston 26 downwardly along with setting sleeve 16, which in turn biases the slips 10 outwardly, as well as the packing element (not shown) for setting of the packer.

Figure 4:
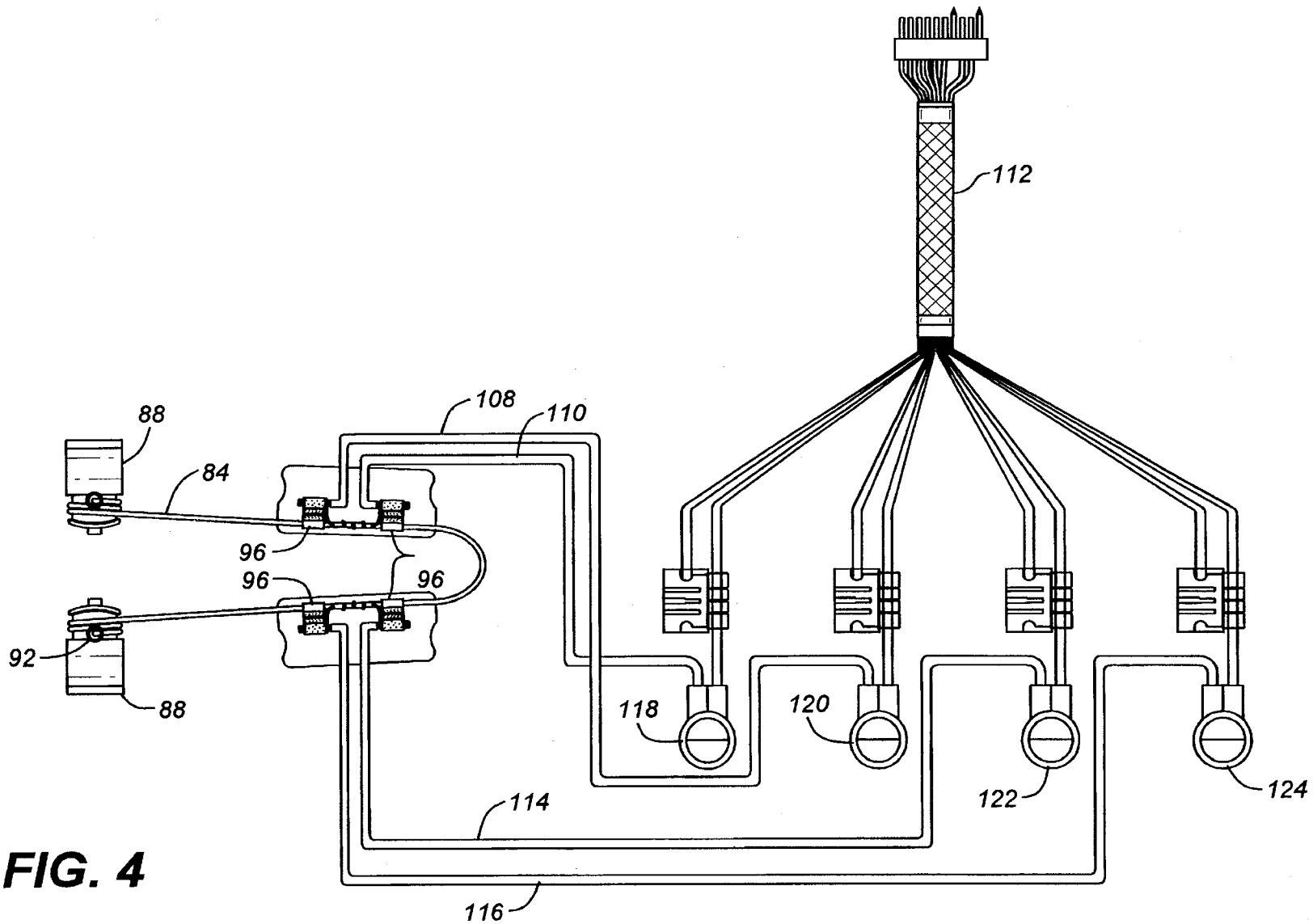
FIG. 4 is a detailed view showing the frangible securing member and the mechanism for its defeat, along with the associated connecting cable.
Figure 5:
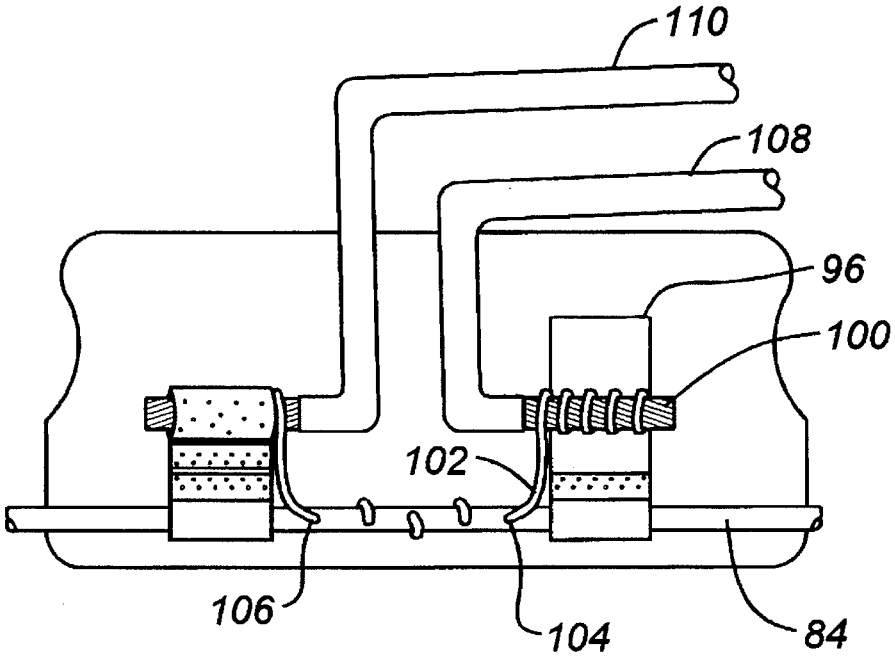
FIG. 5 is a detailed view showing the heating wire installed with respect to the frangible securing element.
Figure 6:
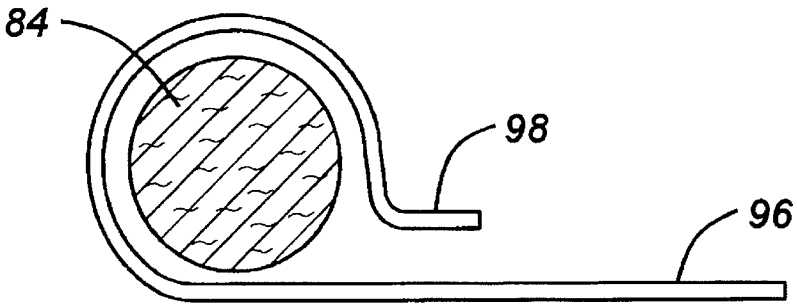
FIG. 6 is a detail of how to assemble a portion of the heating element to the frangible securing material.

Referring now to FIGS. 4 and 5, as well as FIG. 1, it can be seen that in the preferred embodiment, the Kevlar® cable 84, which is preferably approximately a 9"length of 500-lb. Kevlar cord, is secured to the anchors 88 by winding the cable 84 around anchor 88 after slipping it through an opening 92 reverse knot first, then tying each loose end in a knot. It is preferable to make this knot as close to the end of the cable 84 as possible with approximately ⅛ to ¼ overhanging beyond the knot on each end. In the preferred embodiment, an adhesive, such as that known commercially as Super Glue®, is applied to each knot. As shown in FIGS. 5 and 6, a solder tab 96 is used in several places, as shown in FIG. 4. The solder tab is rolled around the cable or cord 84 at a point approximately 2" from the knot on either end. The solder tab is wrapped around the cord 84, allowing sufficient extension on the solder tab to form a lip 98 (see FIG. 6). The lip should be long enough to allow spot welding of the tab 96 to itself. After the cord 84 is wrapped by the solder tab 96, the tab 96 should be squeezed so that it tightly wraps the cord. Thereafter, the lip 98 is spot-welded in place. Approximately 3" of nichrome wire is then cut and inserted through the cord 84 as close as possible to the battery tab 96 (see FIG. 5). The nichrome wire 102 enters the cable 84 at point 104, which is preferably as close to the battery tab 96 as possible. A sewing needle may be used to insert the wire through the cord. Preferably, all but about ¾ of the nichrome wire 102 is pulled through the cord 84 and wrapped 3 complete turns through the cord 84 as it is woven through the cord 84 (see FIG. 5). The turns should be wrapped tightly and as close as possible without actual contact which could create a short circuit, leaving approximately 1/16" between turns so that the distance between the entry point 104 and the exit point 106 is approximately 3/16". As shown in FIG. 5, after emerging from the exit point 106, a similar configuration is used for the second solder tab 96. Leadwires 108 and 110 provide the current to an assembly shown in FIG. 5. As shown in FIG. 4, redundant assemblies are used in the event one of the assemblies fails to operate. The power that heats the nichrome wire 102 comes from the battery pack 76 (see FIG. 7) when actuated by a signal received on strain gauges 72 and 74. The receipt of the appropriate signal at strain gauges 72 and 74 triggers the control system 78 to complete a circuit from the battery pack 76 to leads 108 and 110, which in turn heats up the nichrome wire 102, causing the cord 84 to fail by thermally destroying it at this point. Piston 60 then moves under the net unbalanced force acting in chamber 56 on it (see FIG. 1). The redundant backup system triggers after a time delay, thus providing two opportunities to break cable 84. As previously stated, the signaling mechanism which triggers the printed circuit board 78 to complete the electrical circuit from the battery pack 76 to the nichrome wire 102 is a technique described in U.S. Pat. No. 5,226,494, but other nonelectrical means of communication from the surface to the control system 78 are also within the scope of the invention. The batteries of battery pack 76 are preferably lithium 3-volt Model CR12600SE Sanyo, wired to provide a terminal voltage of 6 volts. The configuration of the battery pack is described below.

The battery pack is comprised of 9 staves. Each stave is composed of two 3-volt Sanyo lithium cells connected in a series to provide 6 volts. Seven of the nine staves are connected in parallel for circuit B2. Additionally, all nine staves are also connected in parallel for circuit B1. B1 and B2 provide electrical power for two circuits. The first circuit (B1) is for the logic and control circuitry and is capable of supplying 2.8 Ampere hours. It is augmented by the parallel connection with B2. The second circuit (B2) provides power for destroying the frangible member through the electronics as described in the preferred embodiment. Since B2 has seven staves in parallel and can supply 9.8 Ampere hours, it performs as backup for B1 in the event of a failure.

The battery pack circuit board is composed of a flexible polyimide film, known as Pyralux® or Kapton®, with printed circuit wiring on or within it. These conductors provide the interconnections necessary to accomplish the parallel circuits previously described.

In the preferred embodiment, the leads 108 and 110 are 24 ga. teflon wire, stripped about 3/16" of insulation from each end, with the end of the nichrome wire 102 wrapped around the stripped end of the wire 108, as shown in FIG. 5. The same construction is employed at lead 110, although FIG. 5 shows the solder tab 96 folded over and spot-welded on the left-hand side and unrolled to allow observation of the winding of the nichrome wire 102 around the stripped end of the lead 108. Any excess of solder tab 96 that exists after wrapping it around the stripped lead 108 is pinched between the cord 84 and the wrapped lead 108. The excess solder tab 96 is spot-welded in place and it is further spot-welded around the stripped leads of wires 108 and 110, as illustrated in FIG. 5 on the left-hand side. The solder tabs 96 and the nichrome wire 102 are preferably wrapped with Kapton tape to prevent short circuits during tool assembly. An expandable braided sleeve 112 is taped on either end as shown after it is slipped over the wires illustrated in FIG. 4. Each nichrome wire 102 has a pair of leads, either 108 and 110 or 114 and 116 (see FIG. 4). The leads 108 and 110 terminate in connectors 118 and 120, while leads 114 and 116 terminate in connectors 122 and 124.

The control circuitry in printed circuit board 78 is preferably programmed to actuate the circuit involving leads 108 and 110 first, and thereafter, with a time-delay, actuate the circuit involving leads 114 and 116 as a redundant backup.

As shown in FIG. 7, a test port 126 can be provided to test the sealing integrity of chamber 36 after the entire tool is assembled. Additionally, communication with the printed circuit board 78 is accessible through a sidewall readout 128 via a terminal so that the control circuits on printed circuit board 78 can be tested after the apparatus A is fully assembled and to program the assembly prior to use.

Figure 3:
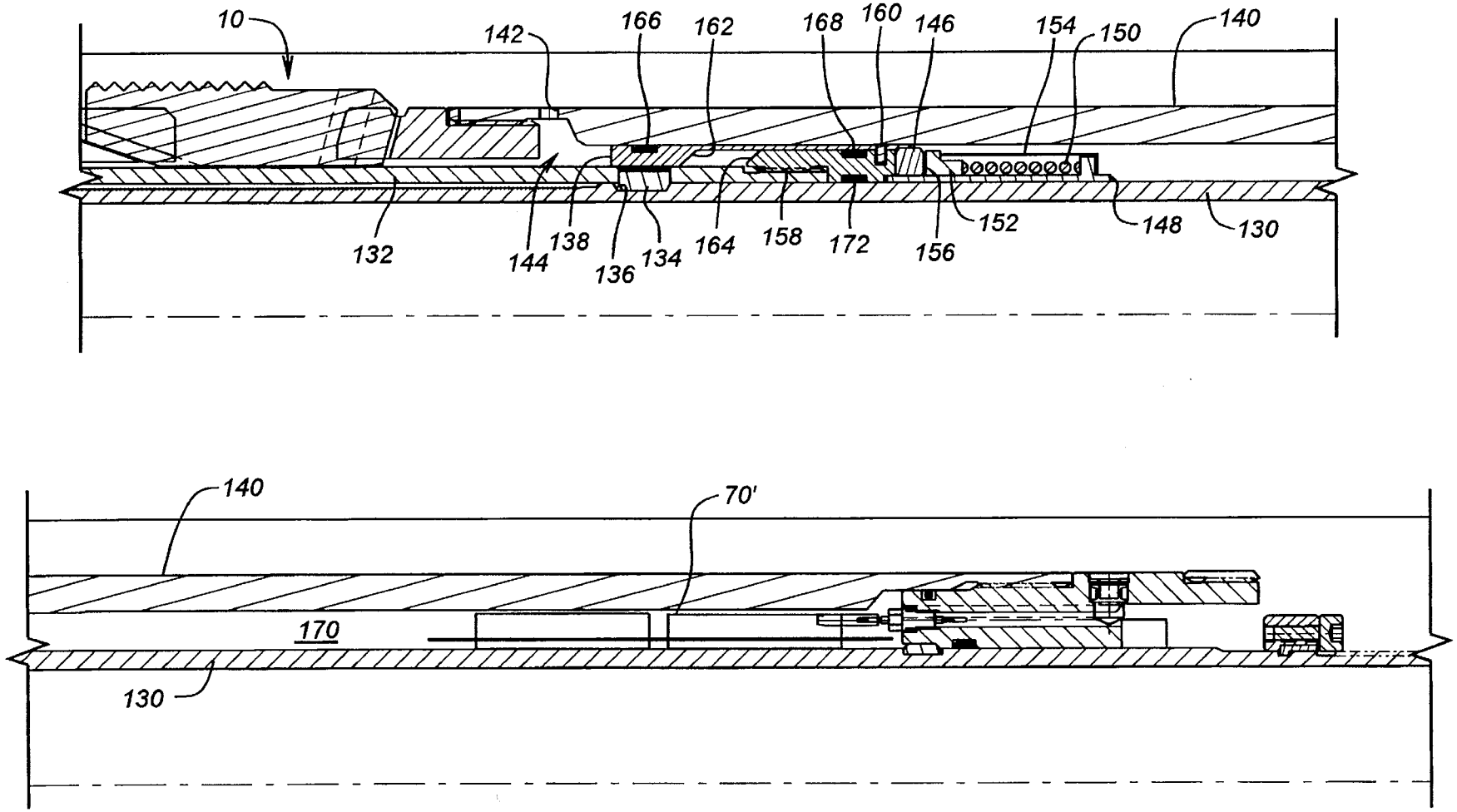
FIG. 3 is an alternative embodiment shown in a sectional elevational view and installed in a packer assembly.

The concepts described above can be used in different mechanical executions to accomplish a function in a downhole tool, as illustrated by an alternative embodiment shown in FIG. 3. Here again, a packer of typical construction is illustrated in that it includes sealing elements (not shown) as well as slips 10.

In this embodiment, the packer has a mandrel 130 and a setting sleeve 132, which is initially locked to it by locking dog 134. Locking dog 134 is trapped in groove 136 of mandrel 130 due to piston 138 being disposed between locking dogs 134 and outer sleeve 140 during the run-in position. During the run-in position, downward movement of piston 138 from wellbore pressure applied to it through bore 142, which communicates with piston 138 through cavity 144, is prevented due to engagement of piston 138 with block 146. Supporting block 146 is sleeve 148, which is disposed between block 146 and mandrel 130. Sleeve 148 is biased downwardly away from block 146 by a spring 150. A cord 154, preferably made of Kevlar® as previously described, extends from a collar 152. Collar 152 supports the cord 154, which extends around and is secured to sleeve 148. When shown in the run-in position as shown in FIG. 3, the cord 154 has tension in it because it is resisting the biasing force of spring 150, thus keeping the sleeve 148 in the position shown in FIG. 3 for run-in. For clarity in FIG. 3, the details of the nichrome wire assemblies described in FIG. 4 are omitted. However, such assemblies are integral to the design used as depicted in FIG. 3, in combination with the components previously described in FIG. 7 and shown in FIG. 3 schematically as 70'.

It should be noted that the collar 152 has a radially oriented opening 156 in which the block 146 is disposed. Block 146 engages the piston 138 on one end and is supported in the run-in position by sleeve 148 at the other end, thus immobilizing block 146. The setting sleeve 132 is engaged to the collar 152 at thread 158. Accordingly, during the run-in position the setting sleeve 132 is immobilized because of locking dogs 134, as previously described, or an alternative nonelectrical signal-receiving device, which converts the received signal into an output signal, triggering the control system previously described to close a circuit, applying power to the mechanism which will unlock the components to set the tool. The block 146 is immobilized because collar 152 is connected to setting sleeve 132, which is in turn immobilized.

As previously described, an appropriate nonelectrical signal is sent from the surface and is received by strain gauges, such as those shown in FIG. 7 in the manner previously described, or an alternative nonelectrical signal-receiving device which converts the received signal into an output signal, triggering the control system previously described to close a circuit, applying power to the mechanism which will unlock the components to set the tool. Thereafter, electrical circuits are completed as previously described, sending current to the nichrome wire which is not shown in FIG. 3 but is present within the cable 154, thus heating the cable to the point of failure. Upon failure of the cable 154, spring 150 biases sleeve 148 downwardly, thus undermining the support for block 146. At that point block 146 can move radially inwardly toward mandrel 130, which frees up piston 138 to move downwardly, shearing pin 160. Upon sufficient movement downwardly of piston 138, locking dogs 134 become liberated. Ultimately, shoulder 162 on piston 138 bottoms on shoulder 164 of collar 152. The pressure in the wellbore in cavity 144 drives piston 138. Since piston 138 is sealed with respect to outer sleeve 140 due to seal 166, and is further sealed with respect to collar 152 due to seal 168, the pressure difference between chamber 144 and chamber 170 results in downward movement of piston 138. Further in view of the presence of seal 172, the difference in pressures between chambers 144 and 170 ultimately results, after bottoming of shoulder 162 on shoulder 164, in a tandem movement of piston 138 and setting sleeve 132 which pulls setting sleeve 132 downwardly, actuating slips 10 outwardly as well as the packing element (not shown) so that the packer is set in the customary manner.

Figure 17:
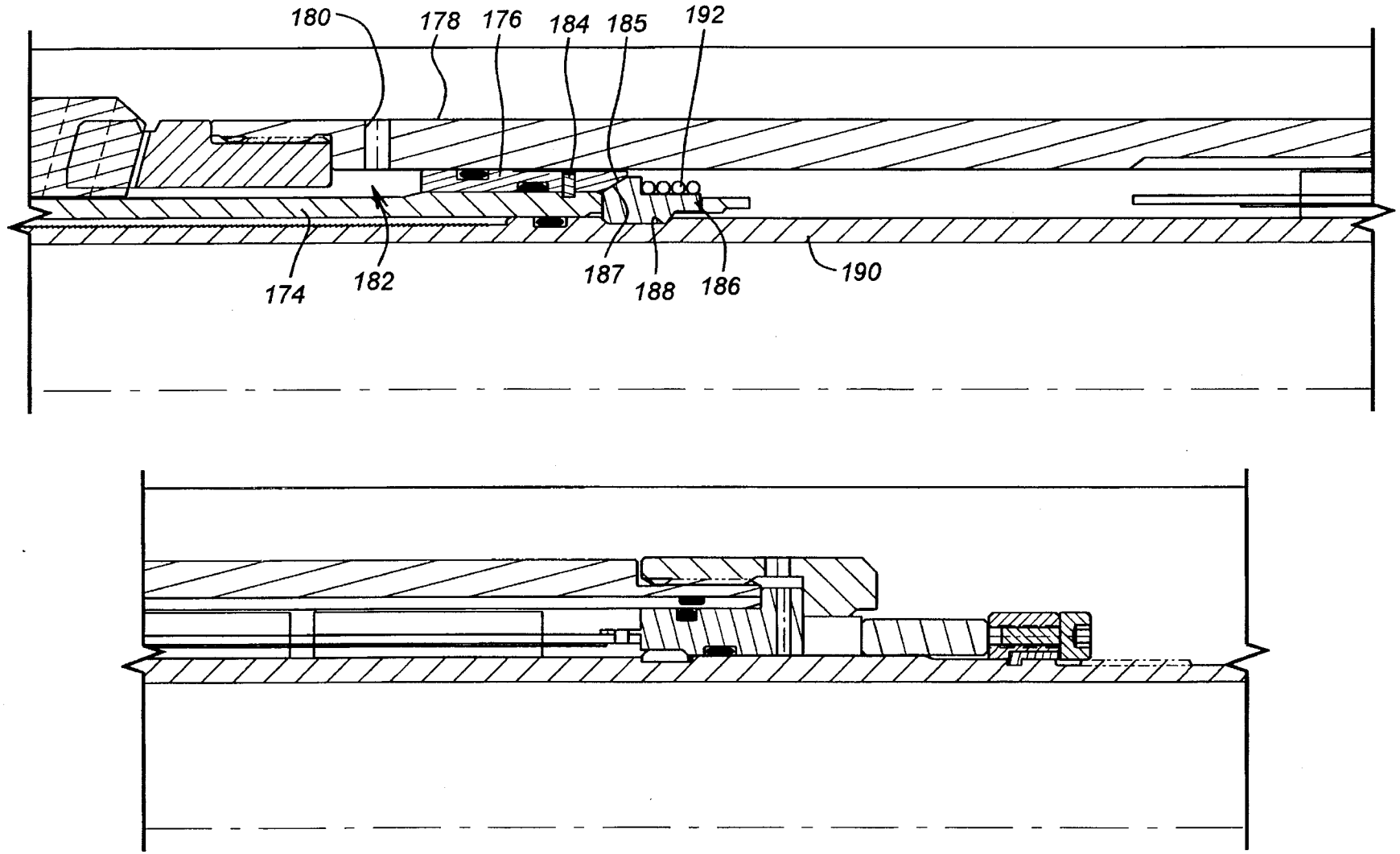
FIG. 17 is an alternative embodiment to the embodiment shown in FIG. 2 and 3.

FIG. 17 illustrates yet another mechanical execution using the apparatus and method of the present invention. FIG. 17 illustrates another version of a standard packer assembly, with a setting sleeve 174. Setting sleeve 174 is connected to a piston 176. Piston 176 is disposed between the setting sleeve 174 and the outer sleeve 178. The pressure of the wellbore fluids is communicated to the piston 176 through bore 180 and cavity 182. Piston 176 is prevented in the run-in position from moving downwardly and taking with it setting sleeve 174 due to pin connection 184 by virtue of stop block 186. Stop block 186 extends into groove 188 in mandrel 190. Securing stop block 186 during the run-in condition is a cable 192, as previously described for the other embodiments. The same control circuitry and nichrome wire are to be used with the embodiment shown in FIG. 17, but are removed from the drawing for clarity in understanding the mechanical operation of the components after the cable 192 fails due to heating from the nichrome wire. As can readily be seen, any forces exerted due to pressure in chamber 182 are resisted by contact between piston 176 and stop block 186, which is itself further prevented from coming out of groove 188 due to the windings of the cable 192 around stop block 186, as well as mandrel 190. Again, as previously described, upon receipt of the appropriate nonelectrical signal from the surface, the control circuitry activates the electrical current through the nichrome wire, heating the cable 192 to the point of failure. Thereafter, with stop block 186 so configured that a net applied force from piston 176 dislodges it from groove 188, downward motion of piston 176 can occur upon failure of cord 192. Downward motion of piston 176 takes with it setting sleeve 174 and in the already described manner sets the slips and the packing elements of a downhole packer. The angle of contact of surfaces 185 and 187 is selected to create a force which will push block 186 out of groove 188 when cable 192 fails from the heat generated by the nichrome wire.

The principles previously described can be used to perform a number of different operations for downhole tools.

Figure 9:
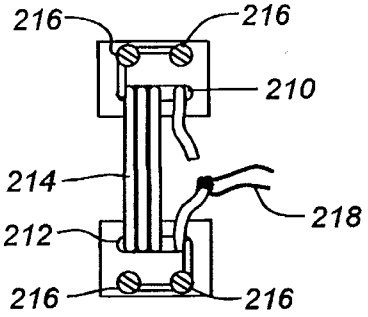
FIGS. 8 and 9 show, respectively, a C-ring shape used to retain elements when the frangible element is whole, as shown in FIG. 8, and showing the final position of the C-ring after breaking the frangible material in FIG. 9.
Figure 8:
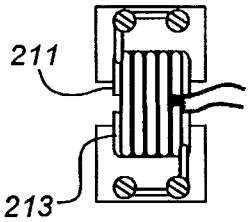
Figure 10:
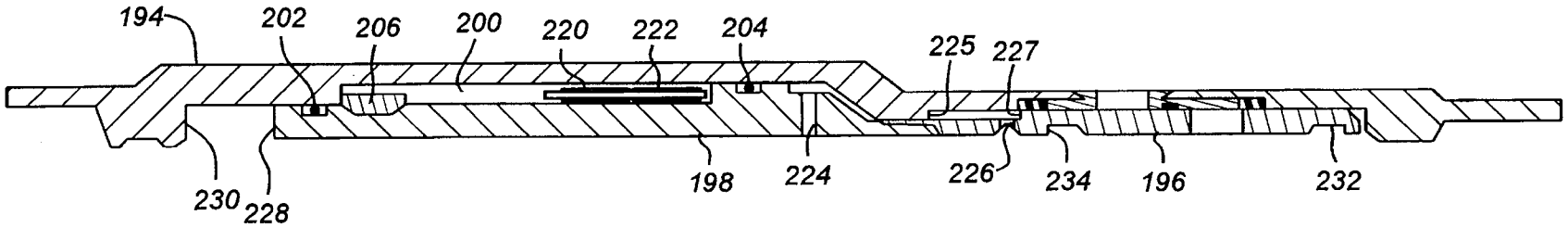
FIGS. 10 and 11 illustrate, respectively, the run-in and open positions for a preferred sliding sleeve member, using the C-ring feature illustrated in FIGS. 8 and 9.
Figure 11:
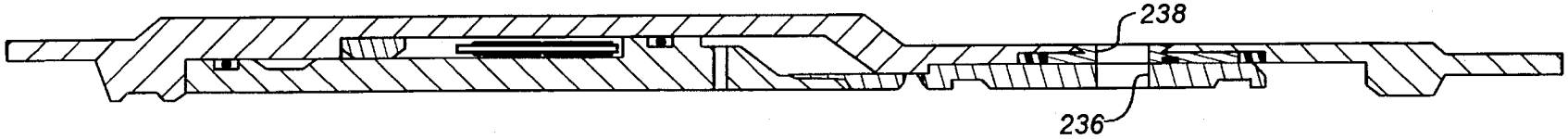

An alternative embodiment of the apparatus A is shown in FIGS. 8–11. In this application, a body 194 includes a sliding sleeve 196, which is connected to a piston 198. A chamber 200 is defined between body 194 and piston 198 and is sealed off by seals 202 and 204. The control system 220, as illustrated in Figure 7, is disposed within cavity 200. A C-shaped ring 206 extends into a groove 208 on piston 198. The details of the C-shaped ring 206 are shown in FIGS. 8 and 9. As can readily be seen, there are a pair of elongated slots 210 and 212 through which the Kevlar® cable 214, as described previously, is wound. A series of terminal screws 216 hold down the ends of the cable 214. A nichrome wire assembly 218 (shown schematically) is connected to the cable 214. The principle of operation for the causation of the failure of cable 214 is the same as previously described with the embodiment shown in FIG. 4. The C-ring 210 has a predetermined amount of stress built into it when the cable 214 is wound through elongated slots 210 and 212. In an alternative embodiment, to prevent fraying of the cable 214 as it passes through slots 210 and 212, a roller assembly 211 and 213 can be used in each slot 210 and 212 so that the cable 214 is, in fact, wound on a roller whose hub is supported adjacent the open ends of C-ring 206 and whose outer periphery passes through slot 210 or 212.

When a nonelectrical signal is received from the surface and is processed by the control system 220, which in turn completes an electrical circuit from batteries 222 to the nichrome wire 218, a weakening of the cable 214 results and ultimate separation occurs of the C-ring 206 to the position shown in FIG. 9 from the position shown in FIG. 8. When that occurs, the C-ring 206 comes out of groove 208 in piston 198. At that time application of tubing pressure through port 224 strokes piston 198, taking with it sliding sleeve 196. In the embodiment illustrated in FIGS. 10 and 11, there is a fracture point 226. The fracture point 226 is located on sliding sleeve 196 such that when piston 198 strokes, a break occurs at the fracture point 226 resulting from shoulder 225 hitting shoulder 227, disconnecting the piston 198 from the sliding sleeve 196. The piston 198 continues its stroke until its upper end 228 hits shoulder 230. Since the sleeve 196 becomes disconnected from piston 198, the sleeve 196 can subsequently be manually operated using conventional shifting tools which engage grooves 232 or 234 for selective movement of sliding sleeve 196. Comparing FIG. 10 to FIG. 11, the shifting of sleeve 196 aligns bore 236 with bore 238 so that flow through the sliding sleeve can occur.

Figure 12:
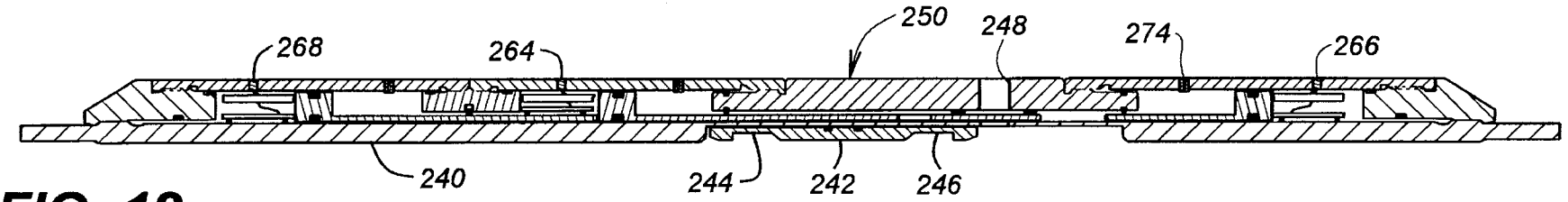
FIGS. 12–16 illustrate another embodiment which provides for sequential movement of valves, showing schematically the operation using the embodiments disclosed in FIGS. 1–3.
Figure 13:
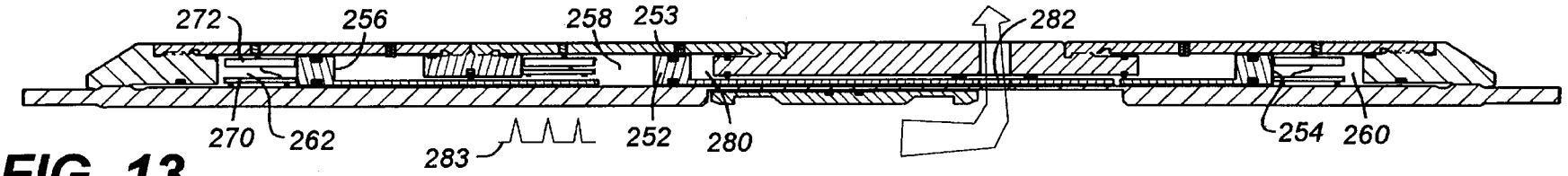
Figure 14:
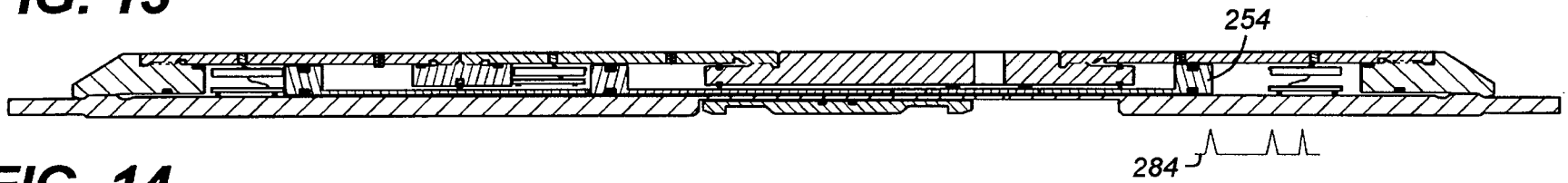
Figure 15:
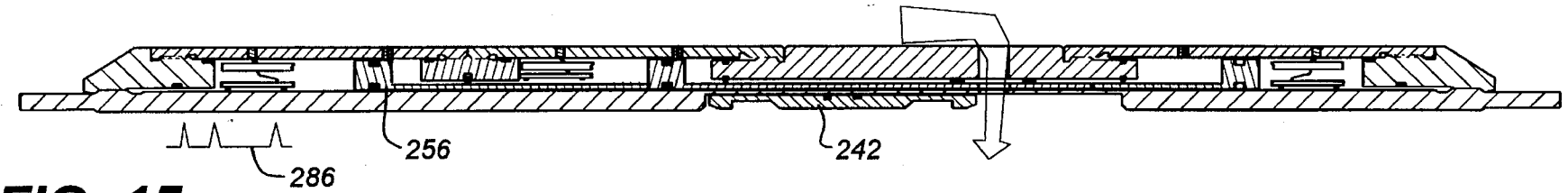
Figure 16:
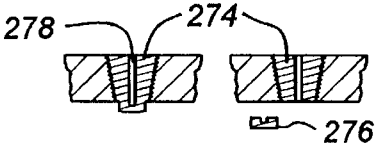

FIGS. 12–16 illustrate yet another application for the apparatus A of the present invention. These figures illustrate multiple movements of sliding sleeves, triggered by different signal patterns from the surface wherein the signals are of a nonelectrical nature. Multiple assemblies, such as that shown in FIG. 7, are disposed in the sliding sleeve tool illustrated in FIGS. 12–16 so that each individual assembly is responsive to a different signal for different movements as required. FIG. 12 illustrates the run-in position where a sliding sleeve valve mechanism, using the apparatus A of the present invention, is shown in a position where the sliding sleeve can be made to open and thereafter close and yet thereafter open again. In this embodiment, the illustrated tool has a mandrel 240 within which is mounted a manually operable sliding sleeve 242. The sleeve 242 has grooves 244 and 246 so that it can be manually actuated using a known shifting tool, if necessary. A lateral port 248 extends through outer sleeve 250 and through mandrel 240. There are three separately actuable pistons 252, 254, and 256. Pistons 252, 254, and 256 are disposed, respectively, in cavities 258, 260, and 262. Cavities 258, 260, and 262 are initially isolated in the run-in condition by a temporary plug material 264, 266, and 268, such as solder, respectively (see FIG. 12). The circuitry, as shown and described with regard to FIG. 7, is disposed in each of the cavities 258, 260, and 262. Looking typically at cavity 262, there is a control logic printed circuit board 270, which, when receiving the nonelectrical signal from the surface, actuates an electrical circuit from the stored power supply, which is preferably a battery bank 272, to apply electrical energy to the plug 268. The same process occurs with the other installations with regard to pistons 252 and 254. In each case, however, the control system on the printed circuit board is sensitive to a different signal so that the sequencing of movement of the pistons 252, 254, and 256 can be controlled in that order, as illustrated in FIGS. 13–15. The plugs 264, 266, and 268 can be made of a material which changes state from solid to liquid so that it can, in its solid state, effectively seal its respective cavity from wellbore fluids, while when energized with electrical current or heat therefrom can change state into a liquid form and, therefore, no longer act as a plug. A commercially available material for this purpose is solder, which can be obtained from a metals supplier. When that occurs, the pressure differential, for example, between the wellbore fluids and chamber 262, initiates flow into chamber 262, thus putting a force on piston 256, causing it to move. The same phenomena occur in the other cavities or chambers 258 and 260. In order to allow any one of the pistons the ability to move, there must be volume displacement upstream of the piston so that the piston can be allowed to progress. To that end, as seen in FIG. 16, the particular piston, for example, 254, will shear off a plug 274 so that when the sheared off component 276 is removed, an internal passage 278 opens up fluid communication into a particular chamber upstream of a piston that is being urged to move. It should be noted that up until the time the sheared off component 276 is actually broken off of plug 274, movement of any of the pistons, such as 254 in chamber 258, results in compression of trapped atmospheric gases upstream of the piston in subchamber 280 (see FIG. 13). However, when the sheared off component 276 is finally broken off, opening up passage 278, the pressure is equalized between chamber 258 and subchamber 280 (see FIG. 13), thus accelerating further movement of a piston such as 252 until seal 253 passes opening 278 in sheared plug 274. The same principle applies in the other chambers illustrated.

Moving from FIGS. 12–15, the lateral port 248 is sealed off in the run-in position by piston 252. An initial nonelectrical signal 283 is sent from the surface which results in downhole movement of piston 252 to align opening 282 in piston 252 with port 248. This facilitates an operation such as acidizing the formation, with flow going through the mandrel 240 and out into the formation through opening 248. After the acidizing is completed, another signal 284 of a nonelectrical type is sent to the apparatus which is now in the configuration of FIG. 13. This signal is different from the first signal sent to actuate movement of piston 252. The second signal schematically represented by pattern 284 can be seen to be different than the signal represented by pattern 283 shown with FIG. 13. Signal 284 triggers movement of piston 254, as shown in FIG. 14. When piston 254 moves, it moves uphole rather than downhole. Ultimately, piston 254 engages piston 252 and displaces it uphole until opening 282 is shifted away from alignment with passage 248, thus closing it off as shown in FIG. 14. Thereafter, a different zone can be acidized following the procedures shown in the movements of the components in FIG. 13. Of course, a duplicate of the apparatus A would be located in the next zone to be acidized and the procedures previously described would be repeated for acidizing the next zone. Yet a third signal 286 (shown in FIG. 15) can then be transmitted from the surface to the apparatus A located downhole which results in movement of piston 256 until it contacts piston 252, pushing it back to the position that it assumed after it was actuated by signal 283 to the position shown in FIG. 13.

Thereafter, the opening 282 once again comes into alignment with port 248 so that production of hydrocarbons can begin or continue. Thereafter, should the port 248 need to be closed, the sleeve 242 can be operated by a shifter of a type known in the art from the surface.

It should be noted that while the specific preferred embodiment of FIGS. 1 and 2 has been described, numerous variations fall within the purview of the invention. The invention is as broad as an application that involves actuation using stored electrical energy in a tool which is triggered by a control system which is in itself responsive to a nonelectrical signal from the surface. Thus, the surface signal can be preferably acoustic or it can be mechanical. For example, if the tool is supported by a nonelectrical cable, the signal can be generated by a sequence of motions imparted to the cable. The same result is obtained if the tool is supported by a tubing string or a coiled tubing. Alternatively, the signal can be transmitted acoustically through the well fluids either within a tubing string or a coiled tubing or on the outside in the annular space. The acoustic signal is measured at the tool by strain gauges connected to the tool which are measuring a strain response to the acoustic signal transmitted in the wellbore. The stresses within the tool are affected by the transmission of the signal in the way that a strain measurable by a pick-up device, such as the strain gauges previously described. However, other types of pick-up devices can be used so long as they are cable of processing a nonelectrical input such as strain responsive to an applied stress, physical movement, be it translation or rotation, for example. The invention is also broad enough to encompass a final controlled element, which can be reliably and predictably actuated using the stored electrical charge in, for example, the battery pack 76, previously described. That is to say, different materials other than the Kevlar® material described for cord 84 can be used without departing from the spirit of the invention. In fact, any mechanism or material which, when energized by electrical current, results in release of components which had heretofore remained in a position where they were locked from movement is within the purview of this invention. Thus, some specific examples can be the illustrations described where the electrical current flowing into solder results in a change of state in solder which allows flow to occur when the solder changes state from solid to liquid. Alternatively, the Kevlar® cable could be subject to cutting by use of a sharp object, such as a knife or a guillotine through which the Kevlar® or other type of cable passes. In this application, the electrical current can be used to actuate the cutting device which mechanically cuts the cable. The mode of failure of the retaining elements, such as a cord 84, can be varied and still be within the purview of the invention. The ultimate controlling element which keeps the components locked to each other until the control system electrically energizes the failure sequence can also be varied without departing from the spirit of the invention. A valve positioned between an actuating pressure and an internal chamber 36, which can be opened or closed by a motor or solenoid or other actuating device and controlled by electronics and battery pack is another illustration. A motor actuated by the control system and battery pack can move a mechanical link from the path of the piston to allow it to move to actuate the downhole tool.

Finally, the mode of signaling the control system to actuate the circuit to provide electrical power to ultimately unlock the components which had heretofore been locked together can be varied without departing from the spirit of the invention as long as the ultimate signaling mechanism used is one that can be readily accomplished by the drilling rig personnel without needing to involve the use of specialty equipment and oil service personnel which typically come with a wireline unit provided to a rig. Other materials than Kevlar® can be used. It is preferable that such alternative materials, if they are to be put into a failure mode by applied heat, exhibit reliable failure tendencies at predictable temperatures so that the desired actuation can occur. Heating materials other than nichrome wire are also within the purview of the invention.

While the invention has been illustrated for use in setting of packers and shifting sleeves, other downhole procedures can be accomplished using the apparatus A and the techniques illustrated herein.

Figure 18:
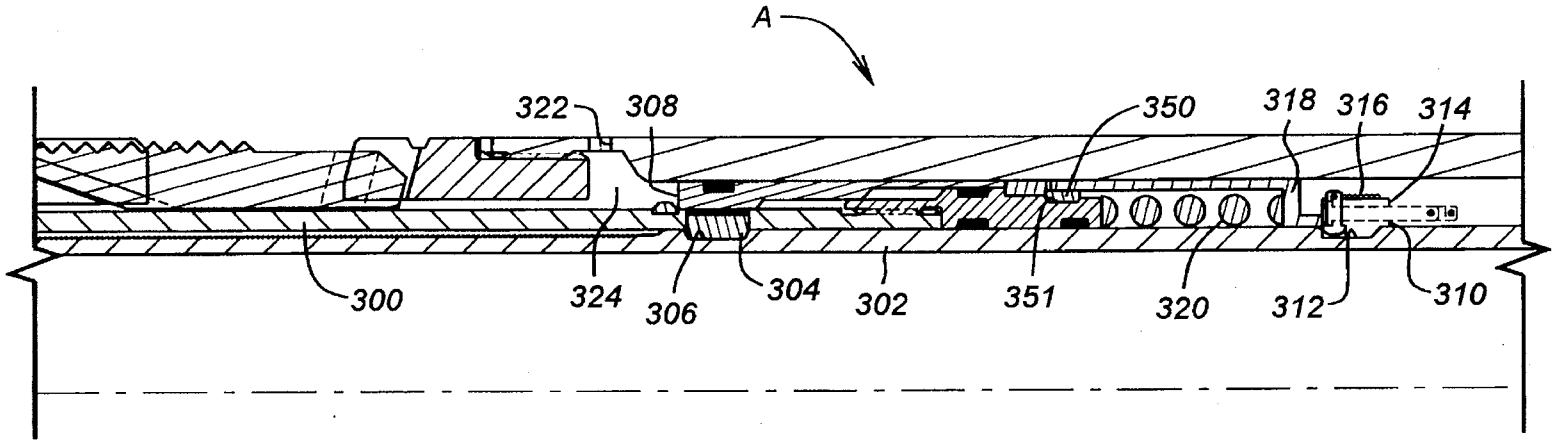
FIG. 18 is an alternative embodiment to the embodiment shown in FIG. 17.
Figure 19:
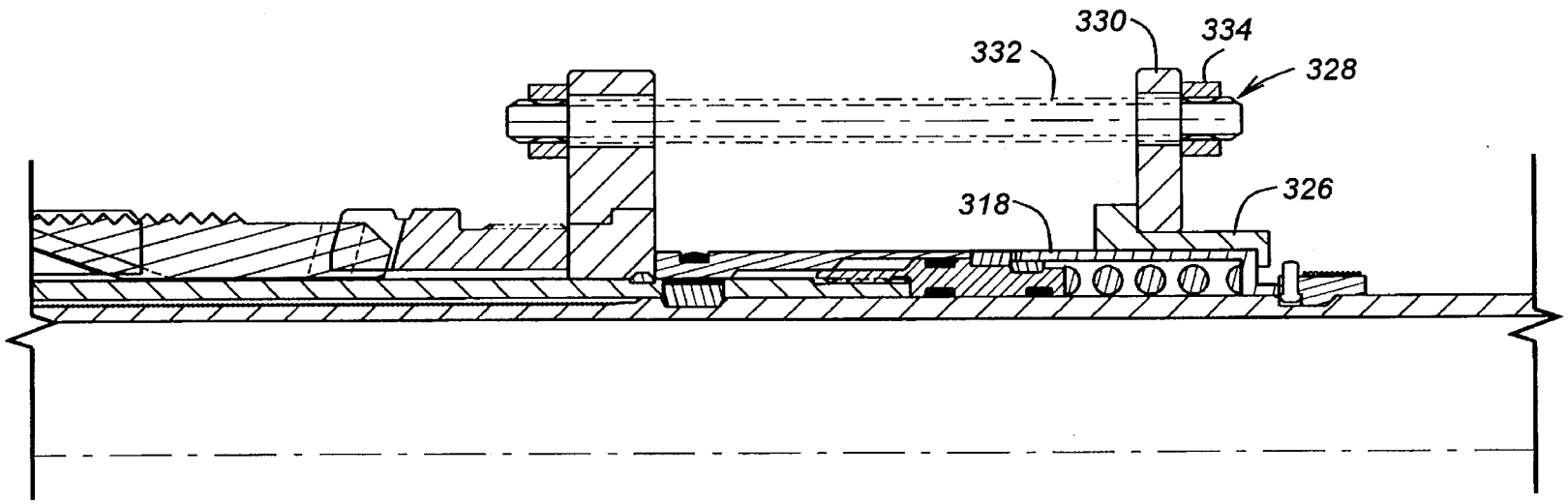
FIG. 19 is a detailed view of FIG. 18.
Figure 20:
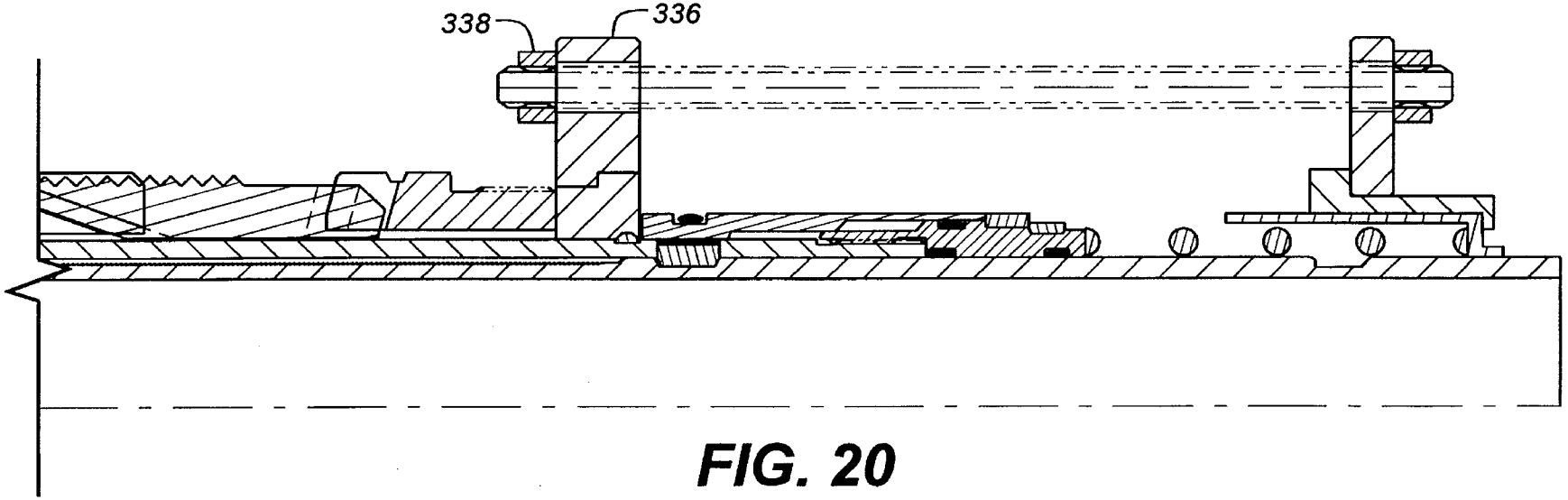
FIG. 20 is the view of FIG. 19 in the released position.

FIG. 18 is an alternative embodiment of the apparatus A of the present invention. It has some similarities to the layout illustrated in FIG. 17. As shown in FIG. 18, a setting sleeve 300 for a packer or similar device is initially locked to a mandrel 302 when a latch 304 extends into groove 306, which is disposed in mandrel 302. Latch 304 is initially held captive in groove 306 by piston 308. In the run-in condition shown in FIG. 18, piston 308 is prevented from moving downwardly because latch 350 is secured to groove 351. Latch 350 is initially held captive in groove 351 by sleeve 318. When the cable 316 is wound around the segmented ring 314, the sleeve 318 cannot move; thus sleeve 318 is immobilized. Spring 320 is trying to push sleeve 318 downwardly. Sleeve 318 is prevented from moving downwardly because segmented ring 314 (see FIG. 21) is secured to groove 312 by the Kevlar® cable 316. In the manner described before for the other embodiments, the Kevlar® cable 316 is caused to fail, which causes segmented ring 314 to expand, thus allowing the force supplied by spring 320 to initiate downward movement of sleeve 318, which allows latch 350 to expand from groove 351, whereupon applied pressure through port 322 acting in cavity 324 moves piston 308 downwardly toward sleeve 318. This liberates latch 304, thus allowing the setting sleeve 300 to move upwardly with respect to the mandrel 302, thus setting the tool. The mechanism illustrated in FIGS. 18–21 can be used to set a packer or another downhole tool.

Figure 21:
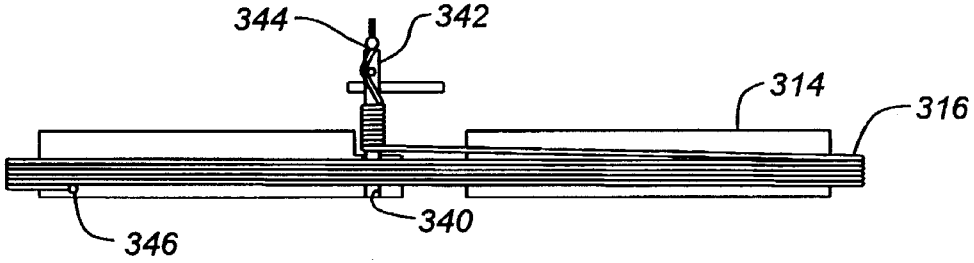
FIG. 21 is a detailed top view of the locking assembly shown in FIG. 18.

FIG. 21 illustrates in more detail the details of latch 310. There, the windings of the Kevlar® cable 316 over a segmented ring 314 are more clearly illustrated. The ring 314 includes a receptacle 340 for a rod 342. The cable 316 is secured at ends 344 and 346 by tying a knot prior to passing the end through an opening in either rod 342 at one end or ring 314 at the other end. When sufficient heat is applied to the cable 316 by the nichrome wire (not shown), the cable 316 breaks and ring 314 springs outwardly, which in turn liberates latch 310 in the manner previously described.

The preferred material for the nichrome wire is a material which can be purchased from California Fine Wire Company of Grover Beach, Calif., which is sold under the mark "Stableohm 650," material No. 100187, annealed 0.005 or 36 AWG wire, 26 ohms ±3% ohms per ft and sold under part No. WVXMMN017.

The foregoing disclosure and description of the invention are illustrative and explanatory thereof, and various changes in the size, shape and materials, as well as in the details of the illustrated construction, may be made without departing from the spirit of the invention.

We claim:

1. A method of actuating a downhole tool, comprising the steps of:

retaining a member on the tool with a frangible element;

lowering the tool to the desired downhole depth;

sending at least one nonelectrical signal from the surface to the tool downhole;

receiving said nonelectrical signal at a control system mounted on the tool;

using an output generated by said control system to weaken said frangible element;

operating the tool due to movement of said member.

2. The method of claim 1, further comprising the steps of:

providing an electrical power supply on the tool;

actuating a main circuit on the tool by said control system to allow electrical current to flow from said electrical power supply to said frangible element.

3. The method of claim 2, further comprising the step of:

heating said frangible element using current flowing in said main circuit;

causing said frangible element to fail by said heating.

4. The method of claim 3, further comprising the steps of:

forming said frangible element in the shape of a cable;

extending said cable in a manner so as to prevent movement of said member when subjected to a downhole applied force.

5. The method of claim 4, further comprising the steps of:

forming said cable from a bundle of strands;

inserting a portion of said main circuit into said strands;

breaking at least one of said strands with heat generated by a portion of said main circuit located in said strands.

6. The method of claim 5, further comprising the steps of:

using a nichrome wire for said portion of said circuit inside said strands;

using a Kevlar® material for said cable.

7. The method of claim 5, further comprising the steps of:

providing a backup circuit in said tool;

inserting portions of said backup circuit into said strands;

breaking at least one of said strands with heat generated by a portion of said backup circuit located in said strands.

8. The method of claim 1, further comprising the step of:

unlocking at least one latch that secures the tool from actuating by movement of said member.

9. The method of claim 1, further comprising the step of:

sending at least one acoustic signal as said nonelectrical signal.

10. The method of claim 9, further comprising the steps of:

making said control system responsive to receipt of at least one said acoustical signal;

providing a plurality of members each retained by a separate frangible element;

using said control system to weaken a plurality of frangible elements responsive to at least one said acoustical signal.

11. The method of claim 9, further comprising the steps of:

making said control system responsive to receipt of a plurality of different acoustic signals;

actuating different outputs from said control system responsive to different acoustic signals;

sequentially weakening different frangible elements using said control system to accomplish sequential movement of different members on said tool.

12. The method of claim 2, further comprising the steps of:

providing an external port on said tool to test or alter the control system after tool assembly;

providing at least one battery for use as the electrical power source in the tool.

13. The method of claim 4, further comprising the steps of:

circumscribing said member at least in part with a partial ring;

retaining said member to a detent in said tool by securing an open part of said ring with said cable;

allowing said ring to expand resulting from cable failure from said heating;

liberating said member from said detent to allow actuation of the tool.

14. The method of claim 13, further comprising the step of:

winding on a roller at least one end of said cable on either side of said opening in said ring.

15. The method of claim 1, further comprising the steps of:

mounting said member in pressure balance;

using solder as said frangible element to obstruct a first port in the tool on one side of said member;

melting said solder with said control system;

shifting said member with an unbalanced hydrostatic force which enters said first port subsequent to said melting.

16. The method of claim 14, further comprising the steps of:

providing an initially sealed second port, on an opposite side from said first port, and in communication with said member;

breaking said initial seal on said second port by movement of said member responsive to fluid pressure applied through said first port.

17. The method of claim 5, further comprising the step of:

unlocking at least one latch that secures the tool from actuating by movement of said member.

18. The method of claim 17, further comprising the step of:

sending at least one acoustic signal as said nonelectrical signal.

19. The method of claim 18, further comprising the steps of:

making said control system responsive to receipt of at least one acoustic signal;

providing a plurality of members each retained by a separate frangible element;

using said control system to weaken a plurality of frangible elements responsive to at least one signal.

20. The method of claim 18, further comprising the steps of:

making said control system responsive to receipt of a plurality of different acoustic signals;

actuating different outputs from said control system responsive to different acoustic signals;

sequentially weakening different frangible elements using said control system to accomplish sequential movement of different members on said tool.

21. The method of claim 20, further comprising the steps of:

providing an external port on said tool to test or alter the control system after tool assembly;

providing at least one battery for use as the electrical power source in the tool.

22. The method of claim 21, further comprising the steps of:

circumscribing said member at least in part with a partial ring;

retaining said member to a detent in said tool by securing an open part of said ring with said cable;

allowing said ring to expand resulting from cable failure from said heating;

liberating said member from said detent to allow actuation of the tool.

23. The method of claim 22, further comprising the step of:

winding on a roller at least one end of said cable on either side of said opening in said ring.

24. A downhole tool, comprising:

a body;

a control system on said body responsive to at least one nonelectrical input signal from the surface transmitted to the tool downhole to generate at least one output signal;

at least one movable member selectively movable, with respect to said body, between a first and second position;

at least one frangible member connected to said control system and selectively retaining said movable member in said first position;

whereupon receipt of said nonelectrical signal, said control system creates an output signal, resulting in failure of said frangible member and subsequent movement of said member from said first to said second position to actuate the tool.

25. The tool of claim 24, further comprising:

an electrical source mounted in said tool;

said control system further comprises a first circuit for facilitating selective conduction of electricity from said source to said frangible member;

whereupon said conduction of electricity results in failure of said frangible member.

26. The tool of claim 25, wherein:

said frangible member is a cable;

said first circuit extending at least in part into said cable;

said portion of said circuit extending into said cable formed of a material which generates heat when electrical current flows through it.

27. The tool of claim 26, further comprising:

a backup circuit extending in part into said cable and having a portion thereof formed of a material which generates heat when electrical current flows through it;

said backup circuit operable by said control system to provide a second way to break said cable if not successfully previously broken by said control system using said first circuit.

28. The tool of claim 26, wherein:

said cable bears directly on said movable member to balance applied forces on said movable member;

whereupon breakage of said cable, an imbalance of applied forces acts on said movable member, causing it to move and actuate the tool.

29. The tool of claim 26, wherein:

said body is formed having a detent;

said movable member initially held to said detent by a partially circumscribing ring, said cable spanning a gap in said ring and initially securing said ring against said movable member to hold it to said detent;

whereupon when said control system heats said cable to failure using said first circuit, said ring expands, freeing said movable member from said detent to allow actuation of said tool.

30. The tool of claim 29, wherein:

said ring further comprises a roller mounted adjacent at least one end of said gap, said cable wound around said roller to facilitate breaking of said cable under heat applied by said first circuit.

31. The tool of claim 24, wherein:

said body comprises at least a first and second port, said ports disposed on opposed sides of said movable member and initially obstructed;

said frangible member disposed in said first port;

a shearable plug disposed in said second port;

said movable member in pressure balance when said first and second ports are obstructed;

whereupon when said control system receives said signal and produces said output signal, said frangible material alters its form responsive to said output signal, opening said first port and causing a pressure imbalance on said movable member, whereupon said movement said movable member shears said plug to open said second port for ultimate pressure re-equalization on said movable member.

32. The tool of claim 26, wherein:

said body further comprises a plurality of movable members, each retained by a frangible member;

said control system causing a plurality of frangible members to fail simultaneously responsive to a single nonelectrical input signal for operation of the tool.

33. The tool of claim 26, wherein:

said body further comprises a plurality of movable members, each retained by a frangible member;

said control system responding to a plurality of discrete nonelectrical signals for sequential failure of said frangible members for operation of the tool.

34. The tool of claim 33, wherein:

each said movable member selectively covers or uncovers a port through said body when moved;

whereupon through discrete nonelectrical signals, at least one port in said body may be opened and closed responsive to said nonelectrical signals.

35. The tool of claim 26, wherein:

said cable is multi-strand;

said circuit extending among said strands and formed of nichrome for said portion thereof;

said electrical source comprises at least one battery capable of raising the strand temperature by heating said nichrome wire to above 500° F. where it is sufficiently weakened so that it fails.

36. The method of claim 1, further comprising:

using a multi-strand cable;

using a control system which extends among said strands and formed of nichrome for said portion thereof;

using a control system which comprises at least one battery capable of raising the strand temperature by heating said nichrome wire to above 500° F. where it is sufficiently weakened so that it fails.

37. The tool of claim 26, wherein:

said control system is responsive to an acoustical signal input.

38. A method of actuating a downhole tool, comprising the steps of:

retaining a member on the tool with a locking element;

lowering the tool to the desired downhole depth;

sending at least one nonelectrical signal from the surface to the tool downhole;

receiving said nonelectrical signal at a control system mounted on the tool;

using an output generated by said control system to move said locking element;

operating the tool due to movement of said locking element, which movement allows said member to move.

* * * * *